United States Patent [19]

Richards

[11] Patent Number: 4,932,804

[45] Date of Patent: Jun. 12, 1990

[54] LOOSE LEAF RETAINER FOR FILE FOLDERS

[76] Inventor: Donna E. Richards, 811 Via Concepcion, Riverside, Calif. 92506

[21] Appl. No.: 272,786

[22] Filed: Nov. 18, 1988

[51] Int. Cl.[5] ..... B42F 13/00

[52] U.S. Cl. ..... 402/75; 402/4; 402/19; 402/20; 402/21; 402/52

[58] Field of Search ..... 402/8, 19, 20, 75, 80 P, 402/80 R, 4, 21, 52, 33; 24/16 PB

[56] References Cited

U.S. PATENT DOCUMENTS

| | | | |
|---|---|---|---|
| 546,484 | 9/1895 | Brown | 383/91 |
| 902,189 | 10/1908 | Wheildon | 402/26 |
| 1,538,249 | 5/1925 | Lorenz | 24/67 R |
| 2,099,881 | 11/1937 | Emmer | 402/20 |
| 3,501,814 | 3/1970 | Anderson et al. | 24/16 PB |
| 3,516,124 | 6/1970 | Merser | 24/16 PB |

FOREIGN PATENT DOCUMENTS

| | | |
|---|---|---|
| 905409 | 12/1945 | France . |
| 239017 | 9/1945 | Switzerland . |

OTHER PUBLICATIONS

IBM Technical Disclosure Bulletin, vol. 14, No. 4, Sep. 1971, "Random Access Binder", Bindewald & Boiney. Physical sample of a file fastener called the "Eldon Fastener".

*Primary Examiner*—Douglas D. Watts
*Assistant Examiner*—Thomas Hamill, Jr.
*Attorney, Agent, or Firm*—Knobbe, Martens, Olson & Bear

[57] ABSTRACT

A pair of flexible retainer strips each of which can be held in ring configuration by a head and socket at opposite ends of the strip which interlock to retain a stack of perforated sheets in a file folder. Each retainer strip is slidably mounted in a separate guide channel formed in an anchor element securable to the cover of a file folder. The ends of the strip can be readily uncoupled to enable the insertion in or removal of a sheet at any location in the stack without having to remove any of the remaining sheets of the stack from the retainer strip.

10 Claims, 3 Drawing Sheets

FIG. 1
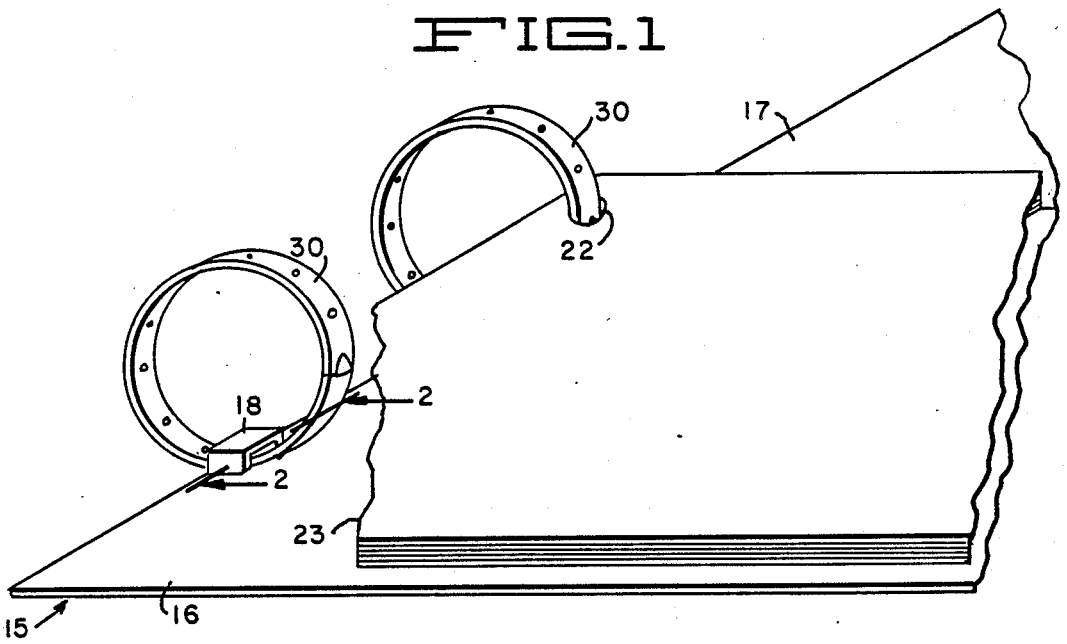
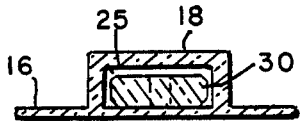
FIG. 2
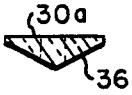
FIG. 3
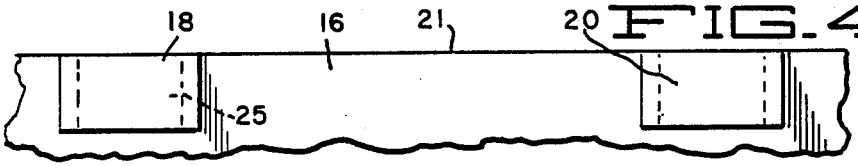
FIG. 4
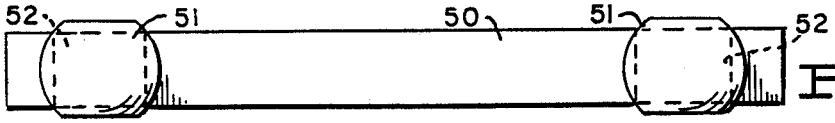
FIG. 5
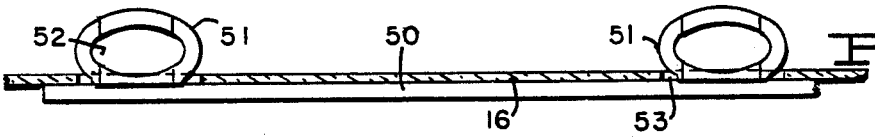
FIG. 6
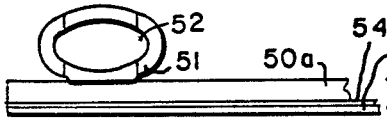
FIG. 7

FIG.13
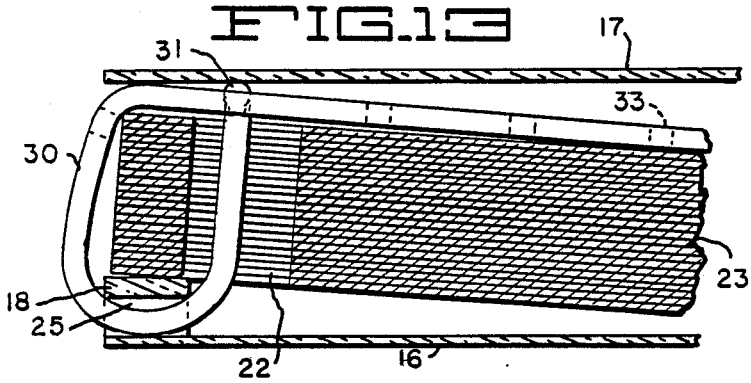
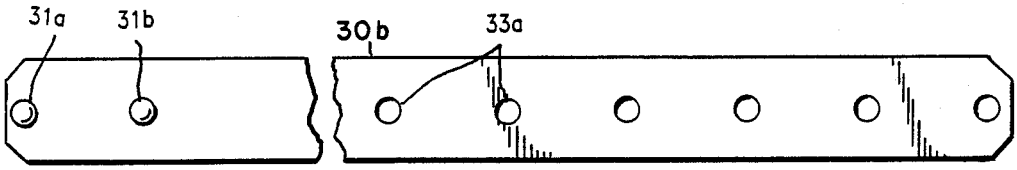
FIG.14
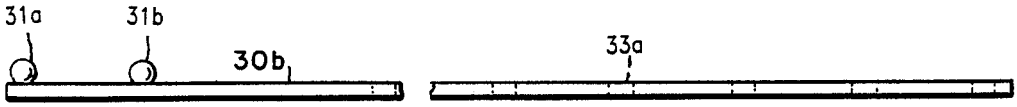
FIG.15
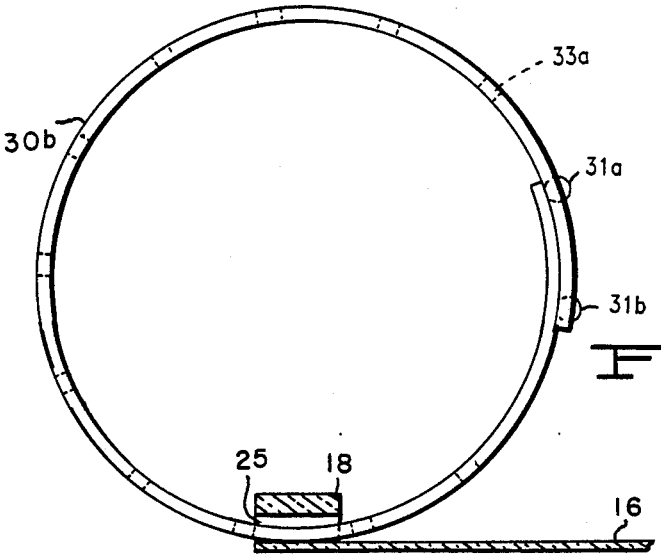
FIG.16

LOOSE LEAF RETAINER FOR FILE FOLDERS

BACKGROUND OF THE INVENTION

1. Field of the Invention

This invention relates to loose leaf file folders and has particular reference to means for removably retaining loose leaves or sheets in such folders.

2. Description of the Prior Art

Conventional loose leaf file retainers generally comprise a U-shaped member having bendable tabs which are inserted through perforations in a file folder cover and in a stack of loose sheets and bent over to retain the sheets in place. In order to insert or remove a selected sheet in the stack, those sheets in the stack above it must be removed from the tabs and then replaced. Although such sheet retainers are generally satisfactory, the process of removing a portion of a stack, particularly if it is quite thick, and then replacing it over the retainer tabs is somewhat tedious and can result in some of the sheets being misplaced or replaced out of order. Also, such retainers generally clamp the sheets together along one edge so that those sheets above a selected one in a stack cannot be laid back flat but must be bent or curled back upon themselves. This presents an inconvenience especially when handling a file containing a relatively thick stack of sheets.

SUMMARY OF THE INVENTION

A principal object of the present invention is to overcome the drawbacks of previous loose leaf file retainers.

Another object is to provide a loose leaf file retainer by means of which any selected sheet in a stack may be quickly and readily removed or inserted.

Another object is to provide a loose leaf retainer permitting sheets above a selected one in a stack to be laid back flat.

Another object is to provide a loose leaf file retainer which can be applied to a standard file folder without any need of modifying the folder.

Another object is to provide a loose leaf file retainer of the above-indicated type which is of simple construction and economical to manufacture.

BRIEF DESCRIPTION OF THE DRAWINGS

The manner in which the above and other objects of this invention are accomplished will be readily understood from the following specification when read in conjunction with the accompanying drawings, wherein:

FIG. 1 is a perspective view, with parts broken away, of a file folder in combination with one form of the present invention.

FIG. 2 is an enlarged sectional view taken along line 2—2 of FIG. 1.

FIG. 3 is an enlarged transverse sectional view of one form of a retainer strip in accordance with this invention.

FIG. 4 is an enlarged plan view of a portion of the FIG. 1 file folder minus retainer strips and sheets shown in that (the latter) figure.

FIG. 5 is an enlarged plan view of an anchor member comprising a modified form of my invention.

FIG. 6 is a side elevational view of the anchor member of FIG. 5.

FIG. 7 is an enlarged side elevational view, with parts broken away, of a modification of said anchor member.

FIG. 13 is a sectional view similar to FIG. 12, but showing the retainer means in a closed file configuration.

FIG. 14 is an enlarged, interrupted plan view of a modified form of said retainer strip.

FIG. 15 is an interrupted side view of the FIG. 14 retainer strip.

FIG. 16 is an enlarged cross sectional view showing the modified retainer strip of FIG. 14 and 15 in open file configuration.

DESCRIPTION OF THE PREFERRED EMBODIMENTS

While this invention may be made in many different forms, certain alternative embodiments are disclosed herein with the understanding that these are to be considered exemplary only and are not intended to limit the invention to those particular embodiments. The scope of the invention will be limited only by the language of the appended claims.

Figure 12:
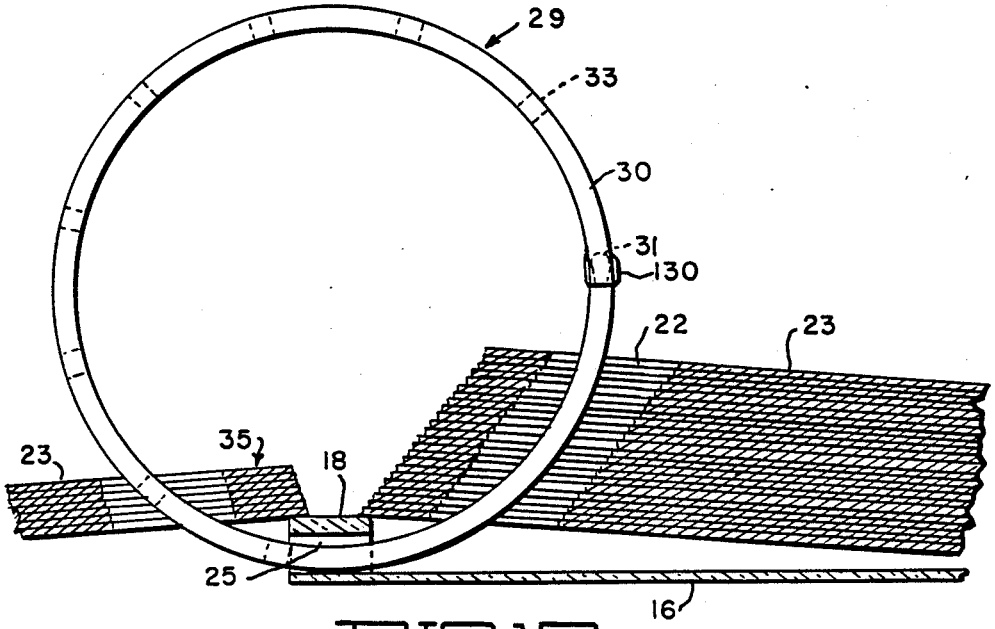
FIG. 12 is an enlarged transverse sectional view showing retainer means in accordance with this invention in open file configuration.

Referring first to FIG. 1, 2, 4 and 10 through 13, there is shown a conventional file folder, indicated generally at 15, comprising file covers 16 and 17 of relatively stiff paper or the like which are suitably hinged together in a manner not shown for movement from an open condition, shown in FIG. 1 and 12, to a closed condition, shown in FIG. 13, wherein one cover is folded over the other to contain a stack of loose leaf sheets 23 therebetween.

A pair of anchor elements 18 and 20 are attached to the file cover 16 and are located directly adjacent the upper edge 21 thereof. The elements 18 and 20 are spaced apart a distance equal to the spacing between perforations 22 of the type normally formed in loose leaf sheets 23 to be placed in a conventional file folder. The elements 18 and 20 are formed with guide channels 25 extending therethrough and may be secured to the inside of the file cover 16 as by a suitable adhesive.

Retainer elements or strips 30 are slidably mounted in the channels 25 of anchor members 18 and 20. Each strip 30 is preferrably formed of a relatively flexible plastic material such as polytetrafluoroethylene (more readily available under the trademark "Teflon"). As shown particularly in FIG. 10 and 11, each strip 30 is of constant width throughout its length and has a bulbous head 31 formed at one end and a mating socket 32 at the opposite end.

The head and socket extend longitudinally of the strip 30 so that the latter may be formed into a substantially ring-like configuration 29 (FIG. 12) with the head 31 frictionally fitted into the socket 32 to retain the ring shape. The strip 30 is bulged or thickened slightly at 130 to reinforce the socket 32 but this bulge is formed between the side edges of the strip and thus will not tend to catch on the edges of the sheet perforations 22 as the sheet or sheets are moved around the ring.

The sizes of the head 31 and socket 32 are preferably such that they will maintain interlocking or coupling engagement with each other during normal usage of the retainer but can be separated by pulling the ends of the strip apart when desired. The strip 30 also has a series of spaced holes 33 formed along the length thereof and of a diameter similar to the diameter of the socket 32. Thus, the head 31 may be frictionally engaged in any of these holes in the manner illustrated in FIG. 13.

Referring to FIG. 12, wherein the folder is shown in its open condition, the ends of the strips can be uncoupled, the perforations 22 of a stack of sheets 23 fitted around the lower ends of the strips 30 and the ends then coupled together again. If a particular sheet 23 is to be removed from the stack, those sheets above it can be swung around the rings 29 and laid back flat as indicated at 35 in FIG. 12. The ends of the strips can then be uncoupled and the selected sheet readily removed (or a new sheet inserted at that place in the stack). The rings 29 may be slid within the guide channels 25 as desired to locate the ends thereof in suitable positions to accommodate stacks of different thicknesses.

When the file folder is to be closed, the ends of each retainer strip 30 are uncoupled and the strips are flexed into the position shown in FIG. 13, clamping the sheets together. The head 31 is then fitted into the nearest hole 33, thus maintaining the stack in position and allowing the cover 17 to be folded into closed condition. The slack ends of the strips rest on the uppermost sheet 23.

The retainer strips 30 may be of any desired cross sectional shape, provided they can slide endwise through the associated guide channels 25. For example, FIG. 3 illustrates a differently shaped strip **30*a* having a beveled underside 36**.

FIG. 5 and 6 illustrate a modified form of the invention in which a separate anchor member 50 is substituted for the integral anchor elements 18 and 20 of FIG. 1 and 4. The anchor member 50 is preferably formed of plastic and has two spaced bulbous heads 51 formed thereon with channels 52 extending therethrough to slidably receive retainer strips such as strips 30. The heads 51 can be passed through perforations 53 in a file folder cover such as cover 16. Forming the perforations 53 of a diameter slightly smaller than the diameters of the heads 51 permits the heads to be pressed or snapped therethrough to retain the member 50 in place.

FIG. 7 illustrates a modified form of anchor member at **50*a*. The latter is similar to anchor member 50 shown in FIG. 5 and 6. However, member 50*a* has a layer of pressure sensitive adhesive 54 on its underside protected by a film 55 of plastic or the like. This anchor member can be mounted on the inside of a file cover, such as cover 16, for use by peeling off the film 55** and adhesively attaching it to the file folder. In this case, of course, the file folder need have no perforations.

Figure 8:
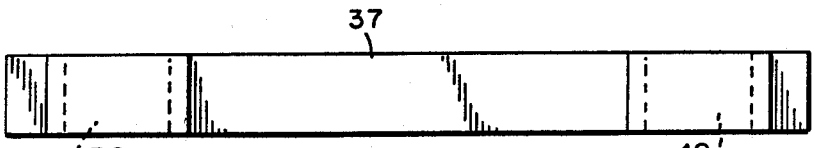
FIG. 8 is an enlarged plan view of another modification of said anchor member.
Figure 9:
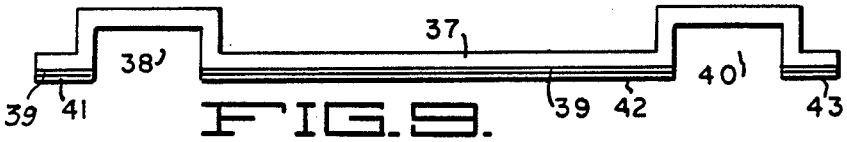
FIG. 9 is a side elevational view of the anchor member of FIG. 8.
Figure 10:
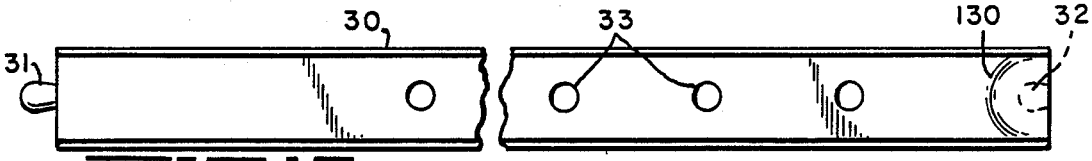
FIG. 10 is an enlarged plan view, partly broken away, of a retainer strip in accordance with my invention.
Figure 11:
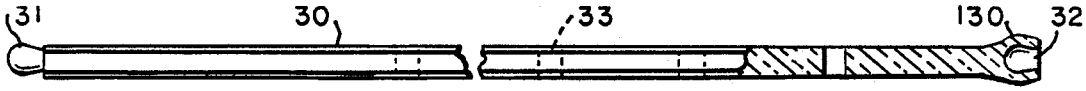
FIG. 11 is a side view, partly broken away, of the retainer strip of FIG. 10.

FIG. 8 and 9 illustrate another modified form of the invention in which a separate or discrete anchor member 37 is provided. The member 37 is formed of plastic or the like material with open-bottom guide channels 38 and 40 adapted to slidably receive retainer strips 30 or the like. Member 37 has pressure sensitive adhesive 39 on its underside protected by films 41, 42 and 43 of plastic or the like. The member 37 can be mounted on the inside of the cover of a file folder by peeling off the protective films 41, 42 and 43 and attaching it to said cover.

FIG. 14 through 16 illustrate another form of the invention comprising flexible retainer strips **30*b* of plastic or the like, each having a pair of spaced bulbous heads 31*a* and 31*b* extending from one side thereof. The heads are located adjacent one end of each strip and a plurality of holes 33*a* are spaced along the length of the strip, any pair of which can be frictionally engaged with the heads 41 and 42. The strips can be passed through the channels 25 of anchor elements 18 and 20, or the like, and then inserted through receptive holes in a stack of perforated sheets, such as sheets 23, after which they can be formed into a ring shape such as illustrated in FIG. 16, with the opposite ends coupled together by interlocking the heads with selected holes 33*a***.

In order to close the file folder, the ends of the retainer strips can be uncoupled and each strip flexed into a shape similar to that shown in FIG. 13, around the retained stack of sheets, and the heads **31*a* and 31*b* then snapped into the nearest pair of holes 33*a***.

I claim:

1. Loose leaf retaining means particularly adapted for holding sheets of paper with aligned perforations in a file folder, comprising:

an anchor retentively cooperative with a file folder forming a guide channel; and at least one retainer strip of flexible material having first and second ends, said retainer strip slidable endwise in said guide channel, said retainer strip comprising:

a socket, disposed at said first end of said retainer strip and integrally connected thereto;

a head, disposed at said second end of said retainer strip and adapted to snap into said socket to form a manually engageable and disengageable interlocking means whereby said retainer strip can be formed into a ring while threaded through said guide channel and aligned perforations in a stack of sheets of paper to retain the sheets in said file folder, said interlocking means selectively disengageable from its interlocked condition to open said ring and permit the removal of any particular sheet of paper from said folder without having to take out all of the sheets of paper above in said stack, as well as permit the insertion of a suitably perforated sheet anywhere in said stack without the necessity of first removing any of said sheets from said retainer strip; and a plurality of longitudinally spaced holes disposed within said retainer strip, each of which is adapted to interlockingly receive said head to thereby accommodate differently sized stacks of paper.

2. Loose leaf retaining means in accordance with claim 1 in which said head and said socket extend longitudinally of said retainer strip.

3. Loose leaf retaining means in accordance with claim 4 in which said anchor comprises a pair of spaced, parallel guide channels each adapted for receiving a retainer strip.

4. Loose leaf retaining means in accordance with claim 3 in which said guide channels extend through a pair of spaced projections on a base member adapted to engage the outer side of a file folder cover with said projections extending through properly spaced openings therein to position said guide channels near the inner side of said file folder cover, whereby a stack of paper with two sets of aligned perforations spaced correspondingly with the spacing of said projections is retained in said folder when one of said retainer strips is threaded through one of said guide channels and one of the sets of aligned perforations in said stack of paper and the other of said retainer strips passes through the other of said guide channels and the other set of aligned perforations in said stack of paper, and each of the retainer strips is in an interlocked condition.

5. Loose leaf retaining means in accordance with claim 3 in which said guide channels extend through a pair of spaced projections on a base member having a layer of pressure sensitive adhesive on one side for attachment thereof to the inner side of a file folder cover with said projections extending away therefrom, whereby a stack of paper with two sets of aligned perforations spaced correspondingly with the spacing of said projections is retained in said folder when one of said retainer strips is threaded through one of said guide channels and one of the sets of aligned perforations in said stack of paper and the other of said retainer strips passes through the other of said guide channels and the other of said aligned perforations in said loose sheets, and each of the retainer strips is in an interlocked condition.

6. An apparatus for selectively retaining a plurality of thin sheets, arranged in a stack together, comprising:

a length of flexible material forming a retainer strip having first and second ends, said strip adapted for insertion through aligned perforations in said stack;

a head portion integrally connected to said strip, proximate said first end;

a socket portion integrally connected to said strip, proximate said second end, said socket portion constructed and arranged to selectively receive and interlockingly retain said head portion so as to form a ring which is rotatable with respect to said perforations; and a plurality of longitudinally spaced apertures, disposed along the length of said strip, each of said apertures capable of frictionally engaging and interlockingly receiving said head portion so as to adjust said ring to a size best suited to accommodate said stack.

7. A file folder, comprising:

a front cover;

a back cover, cooperative with said front cover for enclosing suitably perforated sheets therebetween;

an anchor, suitable for mounting on at least one of said covers, said anchor comprising a pair of aligned apertures, spaced at a distance equal to the distance between perforations in said sheets; and a pair of flexible retainer strips, each having a first end and a second end and adapted for endwise insertion through said apertures in said anchor, each of said strips comprising:

an interlocking structure integrally connected to said strip, proximate said first end; and a plurality of longitudinally spaced apertures, disposed along the length of said strip, wherein each of said apertures is adapted to frictionally engage and interlockingly receive said interlocking structure to form a ring which is rotatable with respect to said aligned perforations in said stack to permit random access to any sheet within the stack.

8. A file folder, as defined by claim 7, wherein said anchor further comprises an adhesive film for mounting said anchor to said file folder.

9. A file folder, as defined by claim 7, wherein said interlocking structure extends longitudinally from said first end of said strip.

10. A file folder, as defined by claim 9, wherein said strip further comprises a socket integrally connected to and extending longitudinally from said second end of said strip, said socket adapted to receive said interlocking structure so as to form a ring.

* * * * *